US005439430A

United States Patent [19]

Rubens et al.

[11] Patent Number: 5,439,430

[45] Date of Patent: Aug. 8, 1995

[54] RESPIRATORY EXERCISER

[76] Inventors: Louis C. Rubens; Jane R. Rubens, both of 503 Linwood St., Midland, Mich. 48640

[21] Appl. No.: 58,771

[22] Filed: May 10, 1993

[51] Int. Cl.[6] ..... A63B 23/18

[52] U.S. Cl. ..... 482/13

[58] Field of Search ..... 482/13; 128/725; 92/250, 251

[56] References Cited

U.S. PATENT DOCUMENTS

| | | | |
|---|---|---|---|
| 2,211,455 | 8/1940 | Caldwell | 92/251 |
| 2,911,270 | 11/1959 | White | 92/251 |
| 3,635,214 | 1/1972 | Rand et al. | 482/13 |
| 5,137,026 | 8/1992 | Waterson et al. | 128/725 |
| 5,246,010 | 9/1993 | Gazzara et al. | 482/13 |

*Primary Examiner*—Richard J. Apley
*Assistant Examiner*—Lynne A. Reichard
*Attorney, Agent, or Firm*—Robert L. McKellar

[57] ABSTRACT

This invention deals with a new and novel dynamic exercising device intended to improve the performance of age or disease impaired human respiratory systems. The device depends on the use of a respiratory exerciser which contains a novel piston which does not itself contact the internal diameter of the tube in which it is situated except for the interface created by a rubber disk which is centered in the piston.

4 Claims, 6 Drawing Sheets

RESPIRATORY EXERCISER

BACKGROUND OF THE INVENTION

This invention deals with a new and novel dynamic exercising device intended to improve the performance of age or disease impaired human respiratory systems.

The human respiratory system must continuously deliver a fresh oxygen supply to all of the body's tissues and organs to maintain human life. Concurrently all of the by-produced exhaust gases produced by oxidative metabolism of fuel molecules in tissue cells must be removed from the body. Efficient functioning of the "almost foolproof" respiratory system maintains constant delivery of fresh air into the tiny lung alveoli. Exhaust gases are returned via circulating blood to the alveoli cavities and removed by exhalation. Human respiration is a well engineered, complex physiochemical process. When specific muscles contract, work is done to lift the weight of the chest and increase the cavity volume, resulting in negative pressure inside the thoracic cavity which causes lung volume to increase. Additional air at atmospheric pressure is then sucked into the newly expanded spaces until internal and external pressures are balanced. As long as air pressure in the tiny alveoli at the ends of the bronchiols remains subatmospheric and there are no obstructions, air will continue to fill them. It is important to remember that the amount of the air that can be inhaled will be related to the fraction of the vital air capacity that has been exhaled prior to inhalation. Additional new air will not enter a cavity already containing air at the same pressure. Air flow through very small diameter tubules is not instantaneous. Flow resistance increases with increase in tube length and decreases with increase in interior diameter of tubes. Pressure differences are critically important to the kinetics of gas movement into lung openings.

During air exhalation, the chest wall and diaphragm relax and the chest cavity volume decreases. Exhalation is a passive process during normal breathing. To exhale, all the body must do is relax. Exhalation occurs when the respiratory muscles relax and the chest springs back to its unexpanded, unstretched shape. The diaphragm rises upward into its uncontracted position. The ribs move inward, and the sternum moves to a lower position. The chest cavity, enlarged a few moments earlier, returns to it's smaller size. As the chest cavity becomes smaller, its walls exert pressure on the lungs, forcing them to occupy a smaller space. As the lungs are pressed inward, and as their own stretchiness, or elasticity, helps them to return back to their unexpanded shape, air is forced out from the alveoli through the bronchi, past the larynx, into the nasopharynx, and out the nose or mouth. It is important to note that exhalation does not empty the lungs entirely. If it did, the alveoli would collapse, greatly increasing the work required for the body to inhale the next breath.

Another reason why the lungs do not completely deflate is that blood is always circulating through them, picking up oxygen and releasing carbon dioxide. If the lungs were empty part of the time, they would contain no oxygen for the blood to pick up, and the journey of the blood would be wasted during that empty time. In fact, even if a person breathes out as much air as possible, about one-fifth of the lung's air capacity still remains filled. This volume called the "residual volume" cannot be exhaled no matter how hard a person tries.

Therefore, the blood's journey through the lungs is always a useful one.

Blowing up balloons, forcing air expiration through pursed lips, and blowing a piece of paper or ping pong balls across the floor are the common recommended procedures for exercising the lungs because the activities require more air velocity than produced by passive exhalation. It seems probable that higher interpulmonary pressure causing higher exhaust gas velocity must be due to involvement of additional breathing muscles, such as abdominal muscles, rather than the simple relaxation of the respiratory muscles. It should therefore be possible to improve the conditioning of these muscles by special exercise regimes, that is, having a person exhale repeatedly against a specific resistance, to provide greater compression of lung alveoli then can occur during normal breathing to help remove additional exhaust gases, and in turn, assist in inhaling larger volumes of fresh air.

Thus, the inventors herein, one personally faced with the problem of low air capacity and reduced ability to exhale exhaust gases, and the other understanding the requirements for building up the vital capacity, collaborated to invent, design and build the devices disclosed herein.

The devices of the instant invention are of the piston and tube type and are new and novel and allow for the convenient exercise of the muscles of respiration to increase vital lung capacity and aid in the recovery of patients suffering from lung incapacity due to age or illness. Also included within the scope of this invention is the novel piston which is used in the lung exercisers.

BACKGROUND OF THE INVENTION

The patentees of existing patents covering the subject of exercisers for the lungs and the like recognized the need for persons inflicted with lung incapacity to exercise the lungs and therefore, that concept is not new.

However, what the prior art patentees did not recognize is that in order for the exercise to be complete, not only did one have to exercise the lungs, but one had to also exercise the muscles associated with breathing. Thus, without this understanding by the prior art patentees, there was no device advocated or disclosed that would exercise the lungs and the breathing muscles, as is evidenced by the numerous patents directed to such tube and piston devices, wherein in each instance, the exhaled air (or inhaled air, as the case may be) is allowed to pass around and/or through the pistons of such devices in order to allow for the control of the movement of the piston and the passage of the pistons of such devices through the breathing tubes without causing too much or too little resistance. If the device does not have the right amount of resistance, then it fails to carry the burden of a full lung exerciser. Thus, too much resistance would not allow for the movement of the piston and would foreclose the use of the device, while on the other hand, too little resistance would not give the benefits of the device.

THE PRIOR ART

With regard to the prior art, there is disclosed in U.S. Pat. No. 3,635,214, issued Jan. 18, 1972 to Rand et. al., a visual pulmonary meter. This pocket-sized pulmonary meter includes a hollow cylindrical chamber for receiving a slidable piston, a breathing tube assembly communicating with one end of the cylindrical chamber to form a flow passageway terminating with a mouthpiece through which a patient can exhale into the chamber and move the piston.

The device of this patent has air exits on one end to regulate the air flow and the piston touches the inside surface of the breathing tube through the use of annular rims at each end of the piston. The piston is designed to allow air flow through the center of the piston as well. Apparently, one must have to rely on the law of gravity in order to have the piston return to the opposite end of the breathing tube once the piston has been forced to the distal end of the breathing tube by exhaled air. It should be noted that devices which depend upon the size and number of orifices to control resistance to flow of expired gas are not reliable because flow velocity is a function of the volume of expired gas from fully inflated lungs relative to residual volume. Resistance to gas flow is a function of gas pressure. Piston sliding in the inventive exerciser herein requires a minimum delta P (difference in pressure), readily calculated from gas laws.

U.S. Pat. No. 4,221,381, issued Sep. 9, 1980, to Ericson, deals with a respiratory exerciser in which there is included a hollow tubular body having at least two openings at one end and an opening at the opposite end. A piston is reciprocally slidable in the tubular body. The piston does not touch the inside walls of the hollow tubular body because the device needs the clearance between the piston the inside walls for flow by of air to operate the piston. The piston can also have hole in it for the restricted passage of air to the other end of the tubular body.

Finally, in U.S. Pat. No. 4,693,256, issued Sep. 15, 1987 to Talonn, there is disclosed a respiratory device which is a spirometer which has a cylinder with a piston slidable in the cylinder. The spirometer has a breathing tube which is aligned at a ninety degree angle to the cylinder containing the piston and the piston does not touch the inside walls of the cylinder, but is instead provided with an outside covering of velour or velvet. The reference does not explain what purpose the velvet cover has. Further, the reference device has air control apparatus on the ends of the tubes to control the amount of air that is moved to the piston. The piston is caused to move by the movement of air through the breathing tube. The operator, upon exhaling through the breathing tube, causes a differential pressure at the intersection of the breathing tube and the cylinder, which causes the piston to move in the cylinder. Thus, when the operator exhales, the piston moves up the cylinder, while when the operator inhales, the piston moves down the cylinder, and the relative movement of the piston is measured by gauges imprinted on the side of the cylinder.

None of the patentees of the inventions described above recognized that size or number of openings whether located around or through the piston, or through the terminal fixtures would provide unreliable resistance to gas flow as expiration velocity changed. Therefore the devices of the patentee's are ineffective breathing exercisers as the lung volume approaches maximal respiratory level, which is important for maximum removal of exhaust gases from the alveoli.

THE INVENTION

This invention deals with a dynamic lung exerciser of the tube and piston type in which the novel piston is supported in the tube by at least one annular rubber ring, which interfaces with, and exerts a positive force against, the inside diameter of the tube and allows for a positive air seal but yet allows the piston to be moved easily with the exhalation of breath. The force required to move the piston in the tube is easily adjusted to meet the requirements of the individual exerciser. This adjustment is accomplished by using the correct diameter rubber ring, the correct thickness of the rubber ring, and the number of rubber rings in the piston.

The invention therefore deals with a lightweight piston for use in a cylindrical tube of the type including two cup-like pieces, at least one flexible disk, and a fastening means, each said cup being configured essentially identical to the other, each said cup comprising a back and an outside diameter; each said cup joined to the other cup in back to back interfacial relationship to form a piston; said cups having at least one flexible disk centered between their joined backs; each said flexible disk having a diameter larger than the largest outside diameter of the cups, said fastening means rigidly securing the cups and the flexible disk together.

This invention also contemplates a novel respiratory exerciser, said respiratory exerciser comprising in combination: A. a piston as described above which contains at least one flexible disk; B. an elongated cylindrical tube having an inside diameter greater than the largest outside diameter of the piston, but smaller than the largest diameter of the flexible disk of the piston; C. a mouthpiece attached to at least one end of the elongated cylindrical tube.

The reciprocally sliding piston of this invention is the most critical part of this invention. Piston design is important to reliably adjust and control resistance to movement of the piston at the pressure differentials of lung exhaust gases. It is important to maintain a gas tight seal between the moving piston and the interior surface of the tube even when the tube diameter changes as much a $\pm 0.25$ min. The use of solid elastomer "O-rings" to bridge the space between the piston and the tube wall results in undesirable changes in the force requirements for movement of the piston, or allows gas leakage past the piston as the tube internal diameter decreases or increases.

The piston should have the characteristic of maintaining a gas tight seal with the tube interior surface during breathing exercises. It should be of a nature such that the force required to move the piston should be easily adjusted to meet the requirements of the individual patient. It should be easily removed from the tube for cleaning and sterilization, and it should be unaffected by chemicals used for these operations. It should be as light as possible and easy to produce from available materials, and the price to a patient should be as low as possible.

BRIEF DESCRIPTION OF THE DRAWINGS

FIGS. 8, 9, 10, 11, and 13 are enlarged out of proportion to the FIGS. 1 to 7, for clearer illustration of the invention.

Figure 1:
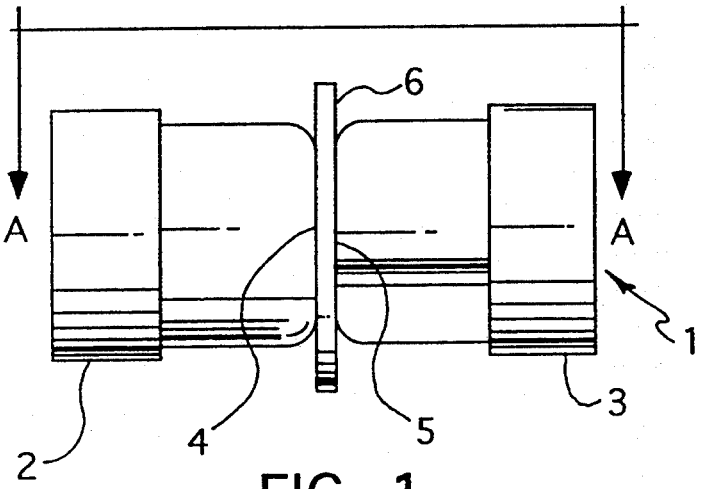
FIG. 1 is a full side view of a single disk piston of this invention showing the back to back cups and the flexible disk centered therebetween.
Figure 6:
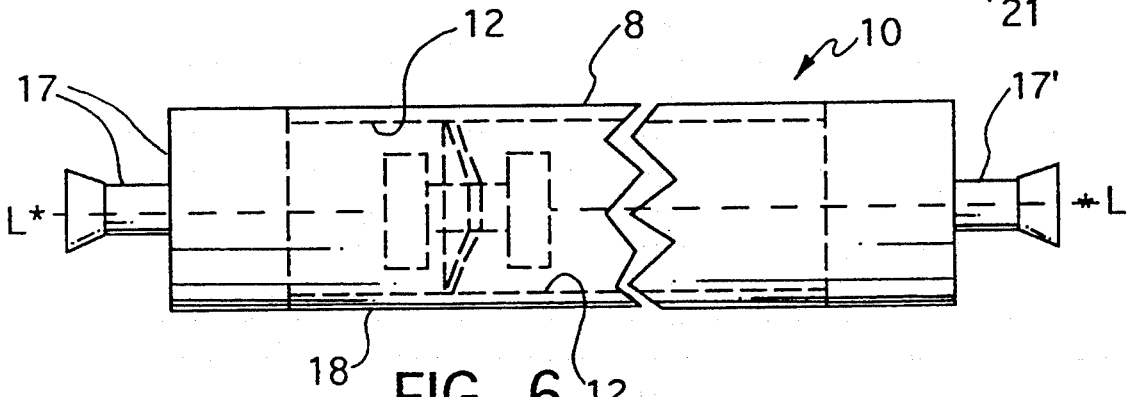
FIG. 6 is a full side view of an exerciser of this invention.

In the description of the invention herein, the term ""long axis" means, with reference to FIG. 1, the line L—L, through the center of the piston 1, and with reference to FIG. 6, the line L'—L' through the center of the cylindrical tube.

DETAILED DESCRIPTION OF THE DRAWINGS

Figure 2:
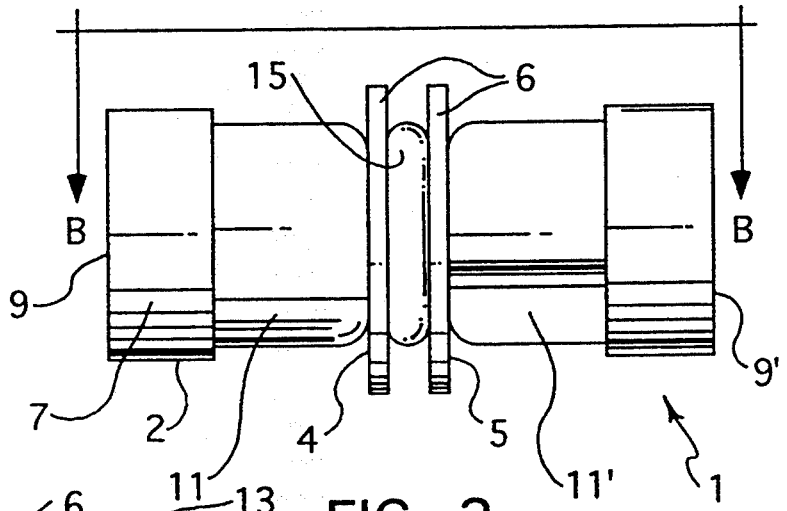
FIG. 2 is a full side view of a double disk piston of this invention showing the back to back cup-like pieces and two flexible disks therebetween, with a single spacer therebetween.

With regard to FIG. 1, there is shown a full side view of one type of a piston 1 of this invention, in which there are two cup-like pieces 2 and 3 which are joined at their back ends 4 and 5 respectively, with a thin rubber, or thermoplastic elastomer disk 6 therebetween. The disk 6 is centered between the two cup-like pieces 2 and 3 so that when the piston 1 is in use, the piston 1 is supported by the rubber disk 6 within the tube 8, such tube 8 to be described infra. The cup-like pieces 2 and 3 are manufactured from lightweight materials, such as rigid plastics, or lightweight metals, in order for the piston 1 be moved in the tube 8 without undue force being required. Minimizing the weight and keeping such weight nearly constant from piston to piston allows one to utilize the proper disk 6, or the proper combination of disks 6 to give the proper resistance to forced expiration. The type of plastic or metal is not critical, as long as the plastic is rigid enough to hold its shape during use. The cup-like pieces 2 and 3 must essentially have a round configuration to conform to the interior of the tube, but is essential for purposes of this invention that the cup-like pieces do not have a uniform diameter along their entire length. The cup-like pieces 2 and 3 must have a step down configuration as shown in FIG. 2, wherein the large diameter hubs 7 and 7' are towards the outer ends 9 and 9' of the cup-like pieces while the smaller diameter hubs 11 and 11' are utilized at the backs 4 and 5 of the cup-like pieces to give a narrower diameter at the center of the piston 1. This is essential for this invention, since the requirement herein is for the piston 1 to be supported in the tube 8 by the flexible disk 6, and while some out-of-round of the cup-like pieces 2 and 3 can be tolerated, it is essential that the piston 1 be narrow at the center to accommodate the bending of the rubber disk 6 when the disk 6 is caused to move. If the piston 1 was not narrow at the center, the disk 6 would bind between the cup outside surface and the inside surface of the tube 8. To help prevent binding of the piston 1 in the tube 8, it is preferred to manufacture the cup-like pieces 2 and 3 as nearly round as is practically possible, while making the outer ends 9 and 9' large enough to come close to the internal surface 12 of the tube 8 as is possible, yet, not touch each other.

Figure 3:
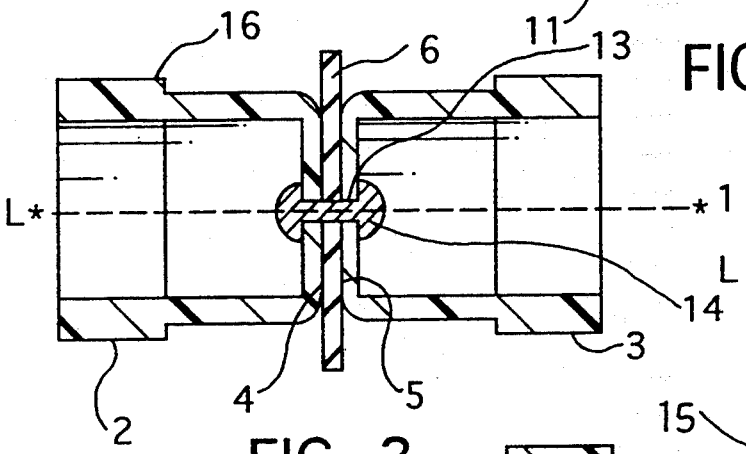
FIG. 3 is a cross-sectional view of a piston of this invention, as shown in FIG. 1, along the long axis and through the center of the piston as shown by line A—A.
Figure 4:
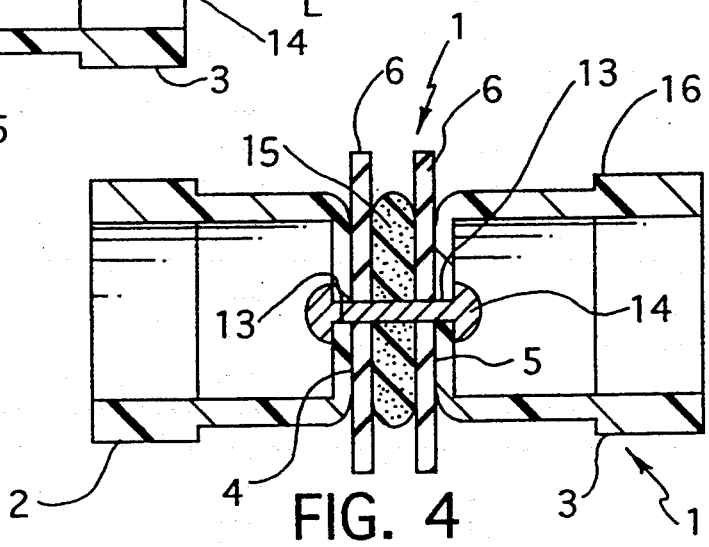
FIG. 4 is a cross-sectional view of a piston of this invention, as shown in FIG. 2, along the long axis and through the center of the piston as shown by line B—B.

As shown in FIG. 3, the rubber 6 has a hole 13 through its center to accommodate a fastening device 14 through it, as shown in FIGS. 3 and 4, which fastening device can be a pop rivet, strong plastic or metal bolts, screws, or the like, as long as the cup-like pieces 2 and 3 and the flexible disk 6 are held firmly and in centered alignment. It is preferred to use lightweight aluminum pop rivets for this invention. It is contemplated within the scope of this invention to glue the cup-like pieces 2 and 3 and the flexible disk 6 together, rather than use a mechanical fastener. A further embodiment of this invention is shown in FIGS. 2 and 4, wherein like numbers have the same meaning as above, and, wherein a double disk 6 configuration is set forth showing the spacer 15 between the disks 6. A detailed disclosure for the flexible disks 6 of the invention is set forth infra in conjunction with the disclosure regarding the exerciser itself.

Figure 5:
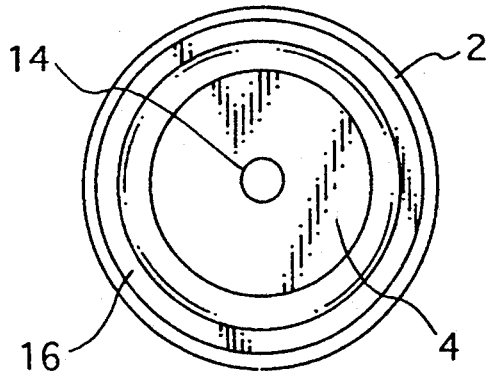
FIG. 5 is a full end view of the piston of this invention.

FIG. 5 is an end view of the piston of FIG. 4, showing the cup-like piece 2, and the fastening means 14. Also shown is the step down shoulder 16. This step down shoulder 16 is essential for the invention as will be discussed infra.

With regard to the novel respiratory exerciser 10 of this invention, and with reference to FIG. 6, there is shown a full side view of the exerciser 10 wherein there is shown a cylindrical tube 8, which forms the housing for the piston 1 and the mouthpieces 17 and 17'. The tube 8 conforms to the generally accepted size used in these types of devices, in that it can be on the order of 2 to 4 inches in diameter with walls 18 having a nominal thickness of 0.0625 to 0.125 inches, with length running the long axis L'—L' of about 18 to 60 inches, the prime considerations being the limitations on overall length and weight that will enable the user to manipulate the device when in use, yet derive the benefits thereof.

Several types of rigid, tough, transparent plastic tubes are available commercially to meet the performance requirements of the instant invention. The tubes can range from very expensive precision bore tubing to tubing that does not have a precision bore. The rigidity should be on the order of about 100,000 to 500,000 pounds per square inch Young's Modulus, and such tube material fitting the requirements of the instant invention are formed from plastics such as polycarbonate, acrylic, butyrate, nylon, polyolefins, and the like. It is desirable to use the highest rigidity modulus while retaining mechanical toughness to minimize the weight of the device. The wall thickness of the tube can be decreased as flexural modulus increases. For example, the modulus of the preferred polycarbonate tube for this invention is about 345,000 psi.

It is not a critical requirement that the tube 8 be transparent. It may be translucent, opaque, or colored, but it is preferred that it be transparent owing to the fact that it is therapeutic to some degree for the patient to watch the movement of the piston 1 in the tube 8. It is contemplated within the scope of this invention to utilize dyed transparent tubing as well such that the tube is colored, but transparent.

As indicated supra, very expensive precision bore tubing is not required for the manufacture of the lung exerciser 10 of this invention in that the special design of the reciprocal piston 1 permits variation of the internal diameter of the tube as much as plus or minus 0.02 inches, without degrading exerciser 10 performance. It is important that mechanical stresses exerted during exercising do not bend the tube 8 along the long axis, or distort the circular cross-sectional shape to change the force requirements for the piston 1 movement. Force requirements of no more than about plus or minus 10% is generally acceptable for this invention. The tube 8 should not be of the type adversely affected by water or fluids, those carried from the patient, or those used for cleaning, or sterilization of the exerciser 10, especially when using detergents and/or bleach. Preferably, but not necessarily, the heat distortion temperature of the tube should be higher than about 100 degrees C.

Tubing which fits the requirements for this invention is obtainable from McMaster-Carr Supply Company, Chicago, Ill., and other commercial suppliers.

As indicated supra, the piston 1, is the key component of this invention and its construction is important to reliably adjust and control resistance to movement at the pressure differentials of lung exhaust gases. It is important to maintain a gas tight seal between the moving piston 1 and the interior surface 12 of the tube even when the tube 8 diameter changes, which can be on the order of plus or minus 0.25 mm. It will be recalled that the flexible disk 6, which is centered between the backs 4 and 5 of the cups 2 and 3 of the piston 1, is a thin rubber or thermoplastic elastomer disk which has a greater diameter than the inside diameter of the tube 8, while the largest outside diameter of the piston 1 is less than the inside diameter of the tube 8. The flexible disk 6 in the piston 1 of this invention thus protrudes from between the cups 2 and 3 and is bent over by its interfacial contact 19 with the inside surface 12 of the tube wall 18 and exerts interfacial pressure to form an excellent gas seal. The degree of bending, and thus the degree of interfacial contact of the disk 6 with the interior surface 12 is very important to this invention. The type of material that the disk 6 is manufactured from is also a major determinant in its usefulness in this invention and preferred for this invention are materials such as ethylene-co-propylene rubber, silicone rubber, vinyl/-nitrile, butadiene-co-acrylonitrile rubber, high strength natural latex, natural rubber sponge, thermoplastic block copolymer elastomers such as Shell Chemical's Kraton, the most preferred being resilient silicone elastomers, ethylene-co-propylene rubbers, and natural rubber. The area of contact and unit force exerted against the inside surface 12 of the tube wall 18 determines the amount of resistance that the piston has against its movement along the long axis of the tube 8. Thus, the amount of protrusion of the disk 6 above the outside diameter of the piston 1, elastic modulus, resiliency, and thickness of the disk 6 are the determining factors, because they are responsible for the amount of interfacial contact that the disk 6 has with the inside surface 12 of the tube wall 18.

The design of the piston 1 permits very accurate control of the force required for piston movement in the tube 8. Movement of the contacting solids (the tube surface 12 and the rubber disk 6) relative to one another is opposed by sliding friction which depends upon the nature of both of the solid surfaces, conditions of sliding surfaces, i.e. roughness, presence of lubricants, and the like, total contact area of the solids, and the force pressing them together. Friction is greater when the piston 1 first starts to move from a resting position. This is a minor effect in this invention because exhaust gas pressure to start movement is greater when exhalation first starts. Frictional force always acts in the plane of sliding and it's direction is opposite to that of motion. No matter which direction the piston 1 moves, friction will be the same when the direction is reversed.

As indicated supra, control of frictional resistance to movement of piston 1 is achieved by selection of construction materials, controlling the total contact area between the deformed flexible disk 6 and the interior tube surface 12, and controlling the normal forces at the solid interfaces. Material selection is important. For example, the material must not be so rigid that it cannot bend within the tube 8, and most importantly, the modulus of the rubber disk 6 must be such that the bent flexible material can be reversed when the operator attempts to move the piston 1 in a reverse movement from one end of the tube 8 to the other, and therefore, the material should have a shear modulus G of between 3 and 50 kg/sq cm.

Sliding friction of different rubbers on another surface may vary several fold. Contact area can also be controlled by using multiple flexible disks or increasing the ratio of flexible disk 6 diameter to the tube internal diameter. Increasing the diameter ratio is a limited solution because as indicted supra, the direction of disc bending must change with the direction of piston 1 movement during breathing exercises. Increasing the disk 6 thickness provides another method of controlling frictional resistance. Normal forces exerted between the solids can be analyzed from simple beam bending theory. When the piston 1 is pushed into the tube 8, friction would be expected to increase in proportion to the cube of the disk 6 thickness. For example, if a disk of 1.00 mm thickness is increased from 1.00 to 1.25, 1.5, 1.75 and 2 mm, respectively, the expected pressure differences required to move the piston 1 would be a factor of 2, 1.95, 3.37, 5.36, and 8, respectively for the thicknesses of the example. From this information, the calculated pressure differentials required for the movement of piston 1 in the tube 8 are 0.047, 0.092, 0.16, 0.25, and 0.38 psi, respectively. Thus, it can be understood that the resistance of piston 1 can be predetermined by measurement, and the appropriate piston 1 can be utilized by the patient to fit the particular therapeutic criteria that is needed by the patient.

For purposes of this invention, the thickness of the rubber disks 6 can range from 0.03 inches to 0.09 inches and the ratio of the outside diameter of the rubber disks 6 to the inside diameter of the tube 8 is about 1.02 to 1.13.

The movement of the piston 1 is provided by the exhalation of the breath of a patient using the device of the instant invention. For purposes of providing a convenient means for the operator to exhale into the device, at least one end of the tube 8 is affixed with a mouthpiece 20. The mouthpiece 20 can be any one of a number of configurations, just as long as the passageway for the exhalation of breath into the device is free and without undue obstruction. The manner of affixing the mouthpiece 20 to the tube 8 is not critical, in that, all that is required is that the mouthpiece 20 be readily attachable and detachable for cleaning and the like. Thus, the mouthpiece 20 can be attached by threaded means, pressure fit, clamping, or some such like method. Preferred for this invention is a pressure fit mouthpiece as shown in FIGS. 8, 9, 10, and 11.

Figure 8:
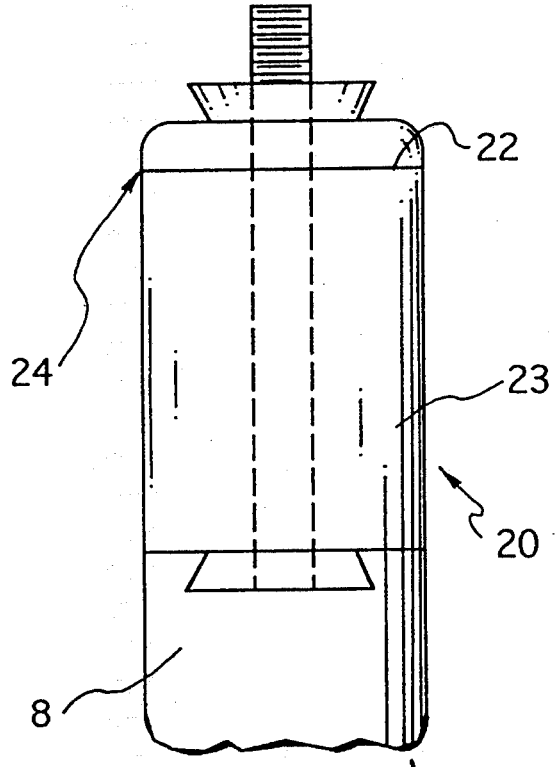
FIG. 8 is a full side view of one of the preferred mouthpieces of this invention, fitted to the end of the tube 8.

With reference to FIG. 8, it can be observed that the mouthpiece 20 is assembled in a tube 8 in the manner that exerciser 10 is ready for immediate use.

Figure 9:
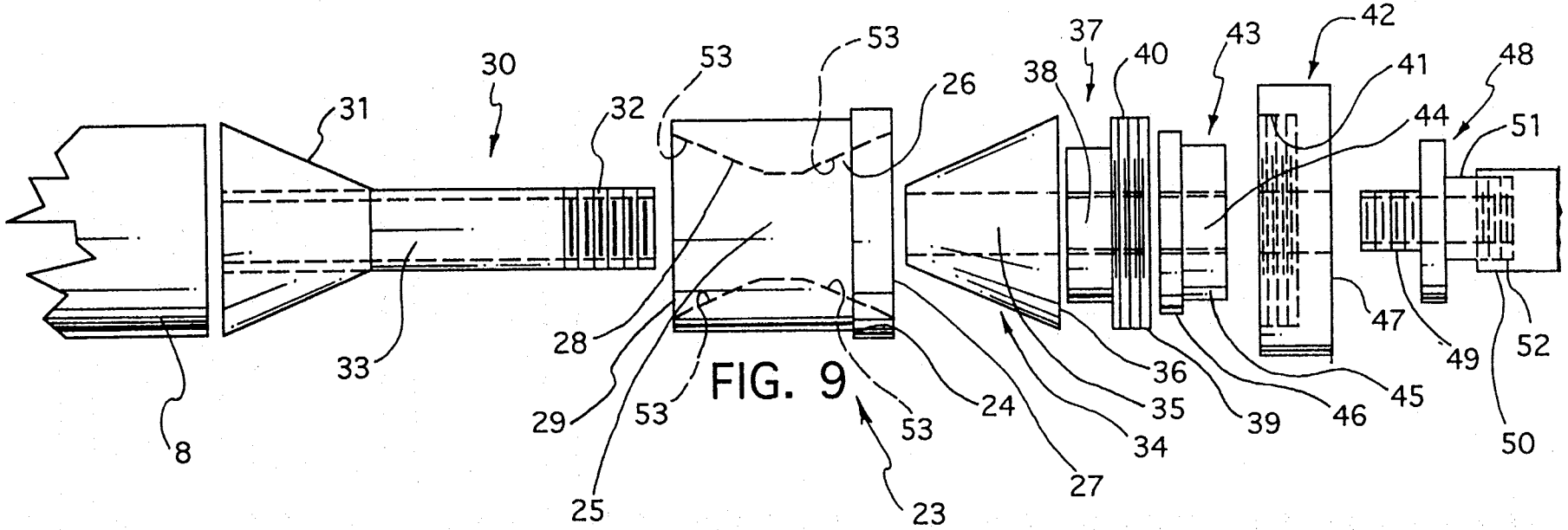
FIG. 9 shows an exploded view of the preferred mouthpiece as shown in FIG. 8, with the exception that the tubing for the operators mouth and its attachment is not shown

In FIG. 9 there is shown an expanded view of the pressure fitted mouthpiece 20 in which there is a sleeve 23, manufactured from rubber, or elastomer, or other moldable material, inserted in the top end 22 (FIG. 8) of the tube 8. The sleeve 23 is integrally molded with a shoulder 24, which fits over the top end of the tube 8 and prevents the sleeve 23 from sliding too far into the top end of the tube 8.

It can be observed that the sleeve 23 has an internal, centered, straight bore 25 (shown in phantom) and that the straight bore 25 has a V-shaped configuration 26 (shown in phantom) near the top end 27 of the sleeve 23, and a like configuration 28 (shown in phantom) near the bottom end 29 of the sleeve 23. There is also shown an insert 30 which has a cone-shaped base 31, a threaded top end 32, and an internal, centered, straight bore 33 shown in phantom), which mates with the straight bore 25 of the sleeve 23. Also, the cone-shaped base 31 slides into the V-shaped configuration 28 (shown in phantom) and mates therewith. The outside diameter of the base 30 at its widest diameter, is constructed so that it will slide easily into the end of the tube 8.

Above the sleeve 23, there is shown a cone-shaped insert 34, which is constructed such that it slides into the V-shaped configuration 26 of the sleeve 23 and rests and mates therewith. The cone-shaped insert 34 has an internal, centered, straight bore 35 (shown in phantom) through it, and the diameter of the straight bore 35 is essentially the same as the straight bore 25 of the sleeve 23. Surmounting the cone-shaped insert 34, and interfacing with the top surface 36 of the cone-shaped insert 34, is a male connector 37 which has an internal, centered, straight bore 38, through it (shown in phantom), which has essentially the same diameter as the straight bore 35 of the cone-shaped insert 35. The top 39 of the connector 37 carries outside threads 40 which mate with the internal threads 41 of the threaded ring 42 discussed infra.

Surmounting and interfacially mating with the male connector 37 is a hubbed connector 43, which hubbed connector 43 has a centered, straight bore 44 through it (shown in phantom). In addition, the hubbed connector 43 has a hub 45, and an annular base 46. The hub 45 is designed to accept a threaded plug or the like, and the annular base 46 is configured such that it fits within the threaded ring 42, which surmounts it, such that the annular base 46 can act as a retaining ring for the hub 45 of the hubbed connector 43.

The threaded ring 42 is designed to fit down over the hub 45 of the hubbed connector 43 such that its interior threads 41 mate with the threads 40 of the male connector 37, and as such, there is an opening 47 (shown in phantom) in the top of the threaded ring 42 which accommodates the hubbed connector 43 therethrough.

There is also shown a threaded fitting 48. Its external threads 49, are insertable and mate with the internal threads of the hubbed connector 43. This threaded fitting 48 is the means by which a breathing tube 50 is attached to the exerciser 10. The breathing tube 50 is directly attached to the threaded fitting 48 near its end 51 opposite the external threaded end 49. A breathing tube 50, having a slightly larger diameter than the opposite end 51 is simply slipped over the opposite end 51 of the threaded fitting 48. Provision is made for clamping the breathing tube 50 onto the opposite end 51, or the opposite end 51 is designed to have annular ridges 52, or some other like means which resist the pulling away of the breathing tube 50.

The mouthpiece 20 is attached to the tube 8, by inserting the cone-shaped insert 30 into the bottom end 29 of the sleeve 23 and surmounting the threaded end 32 of the insert 30 with the cone-shaped insert 34. The male connector 37 is then loosely threaded onto the threaded end 32, and the assembly is inserted into the open end of the tube 8. When the shoulder 24 of the sleeve 23 is firmly seated on the top end of the tube 8, the male connector 37 is tightened down, which draws together the assembly, seating both the cone-shaped base 30 in the V-shaped configuration 28, and the cone-shaped insert 34 into the V-shaped configuration 26. This causes the cone-shaped base 30 and the cone-shaped insert 34 to press the internal, cone-shaped walls 53 of the sleeve 23 which causes the sleeve 23 to press against the inside surface 12 of the tube walls 18, which causes a pressure fit of the assembly in the end of the tube 8 to give an air-tight seal.

Thereafter, the hubbed connector 43 is placed on the top of the threaded ring 42, the threaded ring 42 is threaded down onto the threads 40 of the male connector 37, thereby compressing the male connector 37 and the hubbed connector 43 together. Thereafter, the threaded fitting 48 is screwed down into the internal threads 44 of the hubbed connector 433 to attach the threaded fitting 48 to the assembly. Thereafter, a tubing 50, such as Tygon®, molded rubber, or the like is slipped over the annular ridges 52 on the surface of threaded fitting 48 to complete the assembly.

It should be understood that the above description of the mouthpiece 20 was carried out using the "top end" of the tube 8, but it should also be understood that both ends of the tube 8 can be treated in the same manner to give an exerciser 10 having a breathing tube 50 on both ends thereof.

Figure 10:
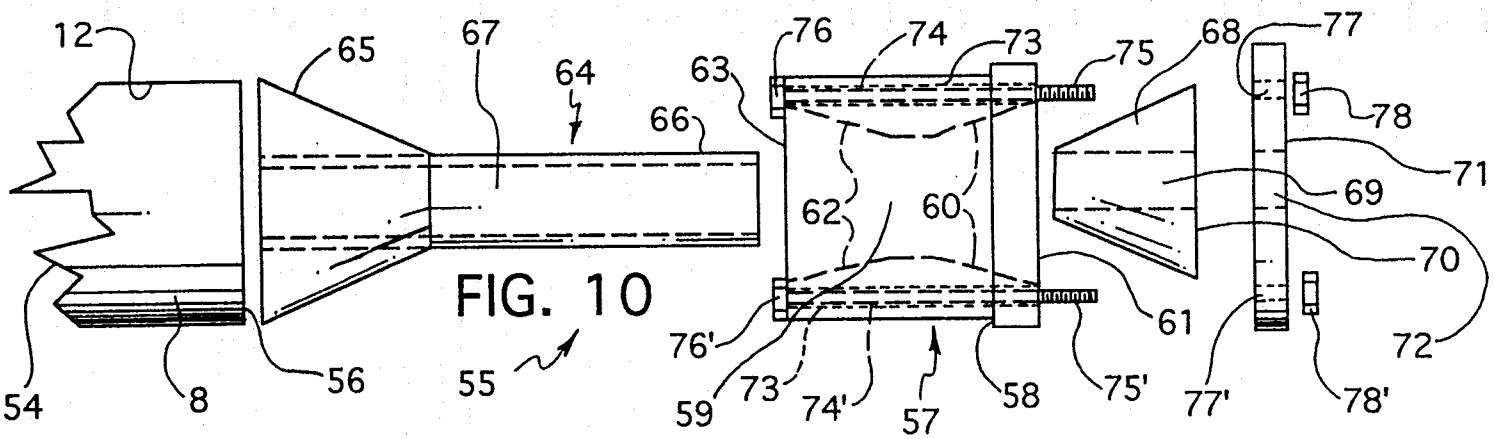
FIG. 10 is a full side view of another embodiment of a mouthpiece useful in this invention wherein the mouthpiece is held in place by the use of bolts and nuts and a pressure plate.

Thus, with reference to FIG. 10, wherein, an exploded view of a mouthpiece of another embodiment is shown with the tube 8 in fragmented construction, in which the fragmented end, for purposes of discussion and illustration herein, will be referred to as the "bottom" or "bottom end" 54, and the opposite end of the tube 8 will be referred to as the "top" or "top end" 56. There is shown the pressure fitted mouthpiece 55 in which there is a sleeve 57, manufactured from rubber, or elastomer, or other moldable material, inserted in the top end of the tube 8. The sleeve 57 is integrally molded with a shoulder 58, which fits over the top end 56 of the tube 8 and prevents the sleeve 57 from sliding too far into the top end 56 of the tube 8.

It can be observed that the sleeve 57 has an internal, centered, straight bore 59 (shown in phantom) and that the straight bore 59 has a V-shaped configuration 60 (shown in phantom) near the top end 61 of the sleeve 57, and a like configuration 62 (shown in phantom) near the bottom end 63 of the sleeve 57. There is also shown an insert 64 which has a cone-shaped base 65, a top end 66, and an internal, centered, straight bore 67 (shown in phantom), which mates with the straight bore 59 of the sleeve 57. Also, the cone-shaped base 64 slides into the V-shaped configuration 62 and mates therewith. The outside diameter of the base 65 at its widest diameter, is constructed so that it will slide easily into the end of the tube 8.

Above the sleeve 57, there is shown a cone-shaped insert 68, which is constructed such that it slides into the V-shaped configuration 60 of the sleeve 57 and rests and mates therewith. The cone-shaped insert 68 has an internal, centered, straight bore 69 through it (shown in phantom), and the diameter of the straight bore 69 is essentially the same as the straight bore 59 of the sleeve 57. Surmounting the cone-shaped insert 68, and interfacing with the top surface 70 of the cone-shaped insert 68, is a flat plate 71 which has an internal, centered, straight bore 72, through it (shown in phantom), which has essentially the same diameter as the straight bore 69 of the cone-shaped insert 68. The sleeve 57 has two or more internal bores running through it near its outside edges and from top 61 through the bottom 63, two of which, 73 and 73', are shown in phantom in FIG. 10. The sleeve 57 is equipped with bolts through the internal bores, and shown in phantom in the bores 73 and 73' are two such bolts 74 and 74' which are terminated at the top end 61 by threads 75 and 75', respectively, and at the bottom end 63 by bolt heads 76 and 76', respectively. Provision is made in the flat plate 71 for the passage of the bolts, in this case, bolts 74 and 74', through openings 77 and 77' ( shown in phantom) and the bolts 74 and 74' are surmounted by threaded nuts 78 and 78'.

In assembly of the mouthpiece 55, the base 64 is inserted into the bore 59 of the sleeve 57, and the bolts 74 and 74' are inserted through the bores 73 and 73', and the cone shaped insert 68 is passed down over the end 66 of the base 64 and seated thereon. The plate 71 is then slipped over the top of the cone shaped insert 68 with the bolts 74 and 74' passing through the openings 77 and 77', and the nuts 78 and 78' are threaded loosely on the bolts 74 and 74'. The entire assembly is inserted into the top of the tube 8, and the shoulder 58 is seated down onto the top 56 of the tube 8, and the nuts 78 and 78' are then tightened down on the bolts 74 and 74', drawing the assembly together, exerting pressure on the cone shaped insert 68, which in turn applies pressure on the sleeve 57 which causes it to expand to fit the internal surface 12 of the tube 8 and hold the assembly tightly therein. The protruding end 66 of the base 64 can then be affixed with a tube or other adaptation for breathing into the exerciser 10.

Figure 11:
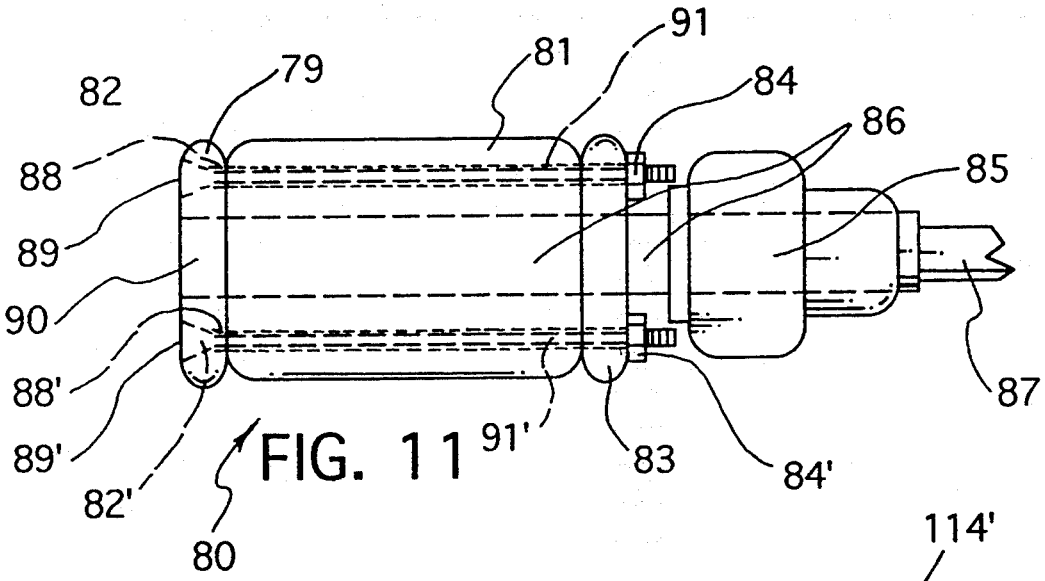
FIG. 11 is yet another embodiment of this invention showing a preferred mouthpiece.

With reference to FIG. 11, there is shown yet another embodiment of this invention with regard to a very simple mouthpiece 80, in which there is shown a rigid plate 79 which forms the bottom of the mouthpiece 80, a molded rubber core 81, two bolts 82 and 82', representing several such bolts, a rigid top plate 83, nuts 84 and 84' threadedly surmounting the rigid top plate 83, a threaded adapter 85, an air passage tube 86 (shown in phantom through the core 81 and the bottom plate 79 and the top plate 83), and pliable tubing 87. The mouthpiece 80 is assembled by inserting the desired number of bolts 82 and 82' through holes 88 and 88' through the bottom plate 79, which holes 88 and 88' have been countersunk into the bottom of the bottom plate 79 to hold the heads 89 and 89' of the bolts 82 and 82. The air passage tube 86 is then aligned center on center in a hole 90 in the bottom plate 79 in a mold, and the top plate 83, with a small amount of the air passage tube 18 extending beyond the top plate 83, and the mold is then poured full of a curable silicone elastomer which forms the core 80. It can be observed that the air passage tube 86 is aligned with, and passes through a hole 90 in the top plate 79, which alignment is positioned before the silicone rubber is poured into the mold.

Thus, the bottom plate 79, the bolts 82 and 82', and the air passage tube 86, are all molded together by the silicone rubber which constitutes the core 81. In the final assembly, the top plate 83, is pre-drilled with holes 91 and 91' and then slipped down over the bolts 82 and 82', and then each bolt 82 and 82' is surmounted by a nut 84 and 84', respectively, it being understood that the illustration of two bolts 82 and 82' is just for the sake of clarity and that a number of bolts can be used along with their commensurate nuts. The mouthpiece 80 is then inserted into the end of a tube 8, until the top plate 83 is aligned essentially evenly with the top edge of the tube 8, and then the nuts 84 and 84' are tightened down onto the top plate 83, which causes pressure on the core 81, which expands and exerts force on the internal walls 12 of tube 8, which holds the mouthpiece securely in the tube 8. When it is desired to remove the mouthpiece 80 from the tube 8, the nuts 84 and 84' are loosened, the silicone rubber core 81 resumes it's normal state, and the mouthpiece 80 can be easily removed from the tube 8. Thus, one does not have to completely remove the nuts 84 and 84' to remove the mouthpiece 80. The adapter 85 is of the standard type as illustrated in FIG. 9.

The above description of the invention is directed to an exerciser which can essentially be used by an operator having the use of one or more of his upper appendages.

In those cases where the operator does not have the use of one or more upper appendages, or is required to maintain a prone position, the exerciser 10 of this invention can be modified.

Figure 7:
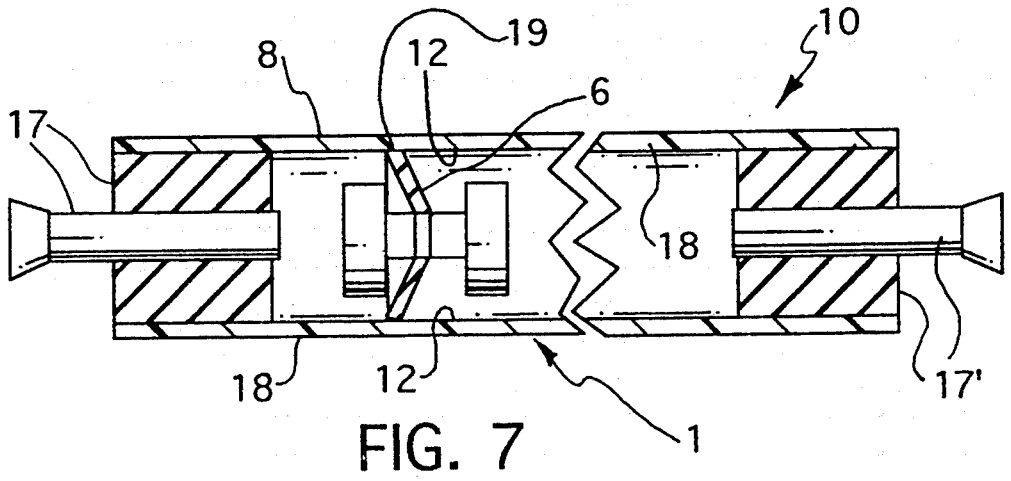
FIG. 7 is a cross-sectional view of an exerciser of FIG. 6 through the line C—C.
Figure 12:
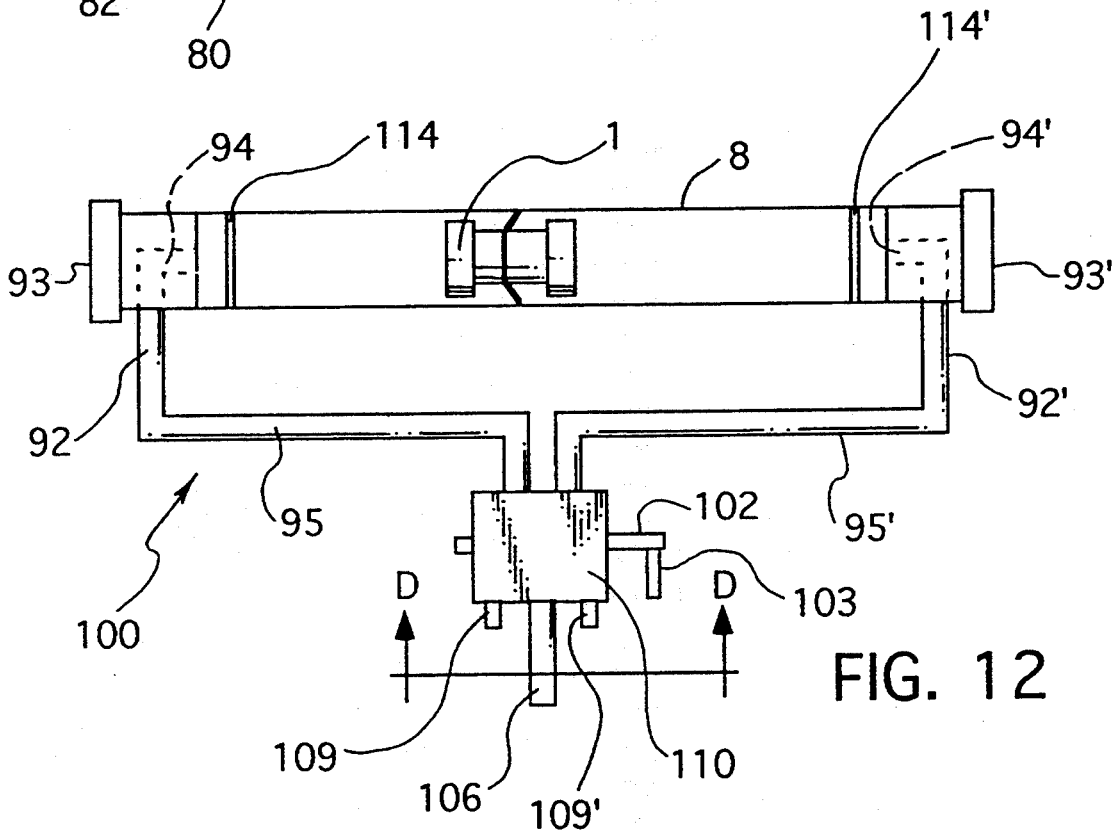
FIG. 12 is a full top view of another embodiment of this invention in which there is used a valve arrangement to control the direction of air flow through the exerciser.

The ends of the tube 8 can be modified for the prone or disabled patient according to FIG. 12 which shows a full top view of an exerciser 100 of FIG. 7 modified with air ports 92 and 92' essentially arranged perpendicular to the long axis of the tube 8, and at each end of the tube 8. Also shown is a reciprocating piston 1. In addition, also shown are end caps 93 and 93' which seal off the tube ends and which prevent the flow of air through the ends of the tube 8 to the outside atmosphere. Internal to the end caps 93 and 93' are tubular openings 94 and 94' which allow for the transfer of air through the rubber end caps 93 and 93', which divert the air flow into the connecting air ports 92 and 92' to essentially describe a closed system. A four-way valve is shown as 110, which connects to the air ports 92 and 92' by way of tubes 95 and 95', the tubes 95 and 95' being made of flexible or rigid tubing which connects to the air ports 92 and 92' respectively, wherein the opposite ends of the tubes 95 and 95' connect to ventricles 96 and 96', respectively (shown in detail in FIG. 13), at the back of the valve 110.

Figure 13:
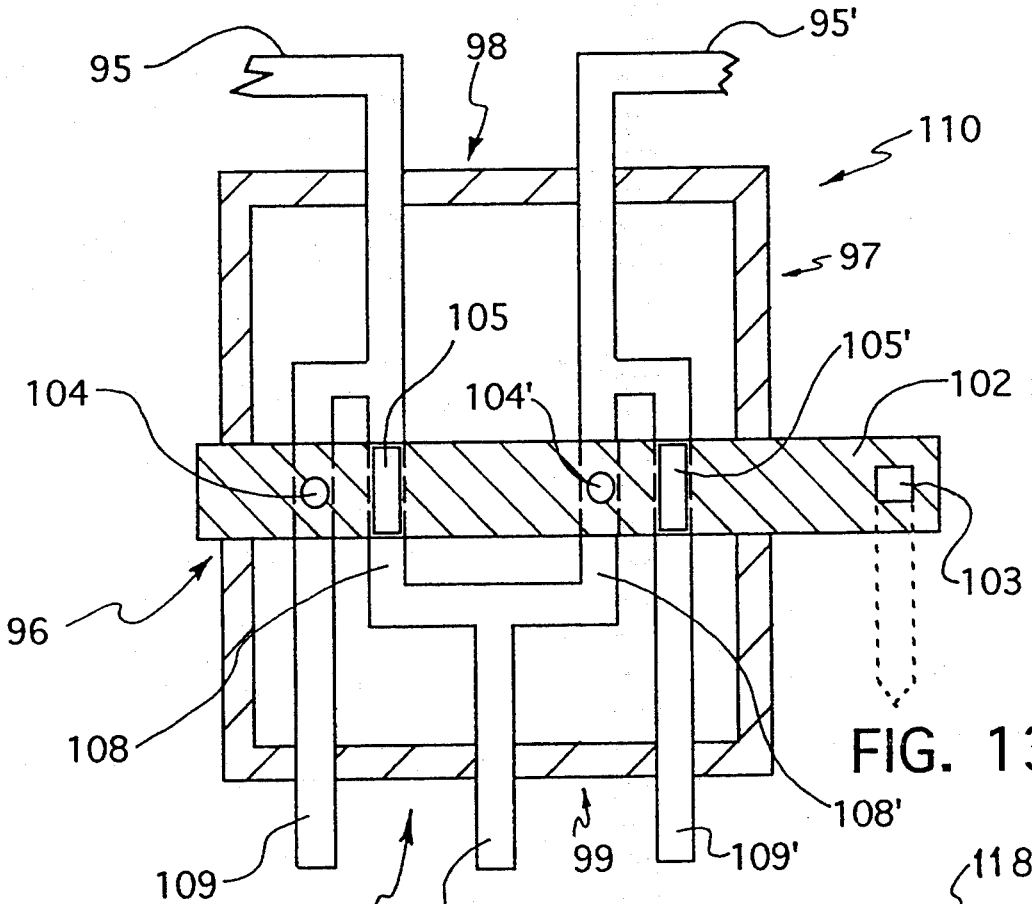
FIG. 13 is an enlarged cross-sectional view from the top, of a valve arrangement useful in the embodiment of FIG. 12 taken along the line D—D of FIG. 12.

For purposes of a detailed explanation of the valve 110, and with reference to FIG. 13 which is a cross-sectional view along the plane of the line D—D of FIG. 12, the left hand side of the Figure is the "left" side 96 of the device, the right hand side 97 of the Figure is the "right", the top side of the Figure is the "back" 98, and the bottom side of the Figure is the "front" 99.

FIG. 13 shows the internal configuration of the valve 100 and this Figure is shown in larger scale in order for clarification, wherein the valve 100 is enclosed in a housing 101. The four-way valve has a rotatable valve stem 102 with a handle 103, said valve stem 102 being located through the center of the four-way valve 110, reaching from left to right. The valve stem 102, which is rotatable by use of the handle 103 has two openings 104 on the left, and 104' on the right which are parallel to each other through the valve stem 102. The valve stem 102 has two additional openings 105 and 105' through it, which are, respectively, left and right openings which are perpendicular to the direction of the openings 104 and 104' through the valve stem 102.

At the front 99 of the valve 102 is an air passage tube 106, through which the patient can breath into the device. This tube 106 extends through the front wall 99 into the middle of the valve 102 and connects with a cross tube 107, which in turn, connects with ventricles 108 and 108', which ventricles 108 and 108' continue to the valve stem 102 and mate with the respective openings 105 and 105', and continue on and exit through the back wall 98 of the valve 110, which it can be observed from FIG. 12, connect with tubes 95 and 95' respectively, to complete the system. Exhaust ports are shown as 109 on the left, and 109' on the right and these exhaust tubes 109 and 109' continue on into the middle of the valve 110, mating in linear alignment with the valve stem 102, and carrying past the valve stem 102 to intersect and connect with the ventricles 108 and 108', respectively With the handle 103 in the vertical position (i.e. in FIG. 13 it is perpendicular to the plane of the paper), the openings 105 and 105' are in linear alignment with the ventricle 108 and the exhaust tube 109', which configuration allows one to breath into the tube 106, the breath is carried through to cross tube 107, which carries the breath to the ventricle 108' where it is blocked by the valve stem 102, and, the breath is carried to ventricle 108, where the opening in the valve stem 102 is aligned with the ventricle 108 and the breath is carried through the valve stem 102 via the ventricle 108 to the tube 95, where it travels via tube 92 and opening 94 (FIG. 12) into the tube 8, and pushes the piston 1 from the left hand end of the tube 8 to the right hand end of the tube 8. This movement of the piston 1 causes dead air in the tube 8, laying to the right of the piston 1, to be forced to the right into the opening 94', through tube 92', into tube 95', into ventricle 108',into exhaust tube 109', and then into the atmosphere. Conversely, when the handle 103 is moved a quarter of a turn out of the vertical position, the openings 104 and 104' are aligned with the ventricle 108' and exhaust tube 109, the openings 105 and 105' are moved out of alignment with the ventricle 108 and exhaust tube 109'. This configuration now allows the patient to breath into the tube 106, which breath is carried to cross tube 107, with blocking at the valve stem 102 at ventricle 108, allowing the flow of the breath through ventricle 108' through opening 104', to the tube 95', which carries the breath to tube 92', through opening 94', to meet with the piston 1, which causes the piston 1 to move in a reverse direction from right to left in tube 8. The movement of the piston 1, causes dead air in the tube 8, located to the left of the piston, to move into the opening 94, through the tube 92, on through tube 95 to the ventricle 108, and into exhaust tube 109, where it exits to the atmosphere. Thus, by simply moving the handle 103 a quarter of a turn, one can switch the air passageways of the valve 110 and cause the piston 1 to be movable from end to end of tube 8.

The valve 110 can also be electrically activated and driven for convenience of a patient with limited mobility in the upper appendages. For example, a paraplegic can activate the valve 110 by applying lip or teeth pressure to a piezoelectric switch built into the mouthpiece. Exhalation pressure required for piston 1 movement can be specifically tailored to a patients capability and needs.

Figure 14:
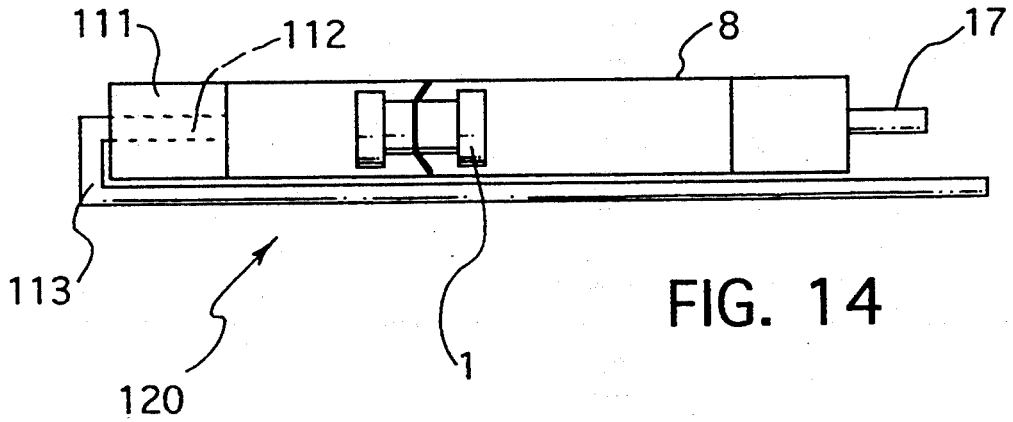
FIG. 14 is a full top view of another type of exerciser useful for patients who do not have full use of their upper extremities and in which there is shown the control of the flow of air by using an elongated tube from one end of the exerciser back to the patient such that the patient does not have to switch the exerciser from one end to the other in order to operate the device.

Another embodiment of this invention is the exerciser 120 shown in FIG. 14, which Figure is a top view of an exerciser 120 wherein there is shown the tube 8, the piston 1, a typical mouthpiece 80 is described above for this invention, an endcap 111 in the end of the tube 8, opposite the typical mouthpiece 80, an opening 112 which is an internal centered bore in the endcap 111, a J-tube 113 which carries the air back to the end of the exerciser from which the patient is operating, and which is used to breath into and move the piston 1 in a reverse direction. Thus, the patient can move the piston 1 without having to reverse the exerciser from end to end. The J-tube 113 can be molded onto, or into, the tube 8, or it can be a free floating tube. It has been found convenient to have a free floating tube to facilitate the cleanability of the device.

Figure 15:
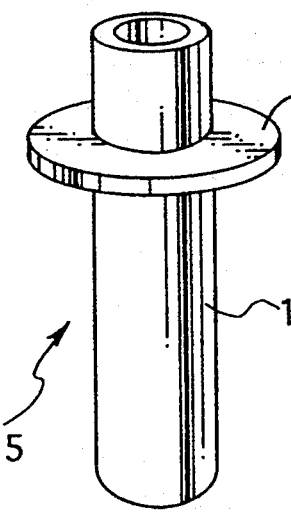
FIG. 15 is a full view of a filter useful in this invention.

Also contemplated within the scope of this invention is the use of filters in the exerciser. These filters should have good capacity to effectively remove and hold most of the water vapor from breath exhaled into the tube; it should be easy to remove, dispose of, and replace with a new filter after use; it should allow for the controlled rate of air passage through the filter during normal use and it must be available at a reasonable cost so that the user will replace ;the contaminated filter frequently. The terminal fixture 17 of the exerciser 10 such as that shown in FIG. 7 offers a convenient design for the insertion of tubular filters. During normal use, expired air will never be inhaled through the in-line filters shown in FIG. 15. In FIG. 15, there is shown a filter 115 of this invention which is shaped like a cigarette with a collar. The filter 115 is a roll of a porous, water absorbent material 116, which has been rolled to form a multilayer filter. The collar 117 is used to stabilize the filter 115 in the terminal fixture 17 of a device of this invention. It is contemplated within the scope of this invention to fashion the filter tube holder out of brass, with a brass washer which can be surmounted by a rubber O-ring to act as a washer in the system.

Figure 16:
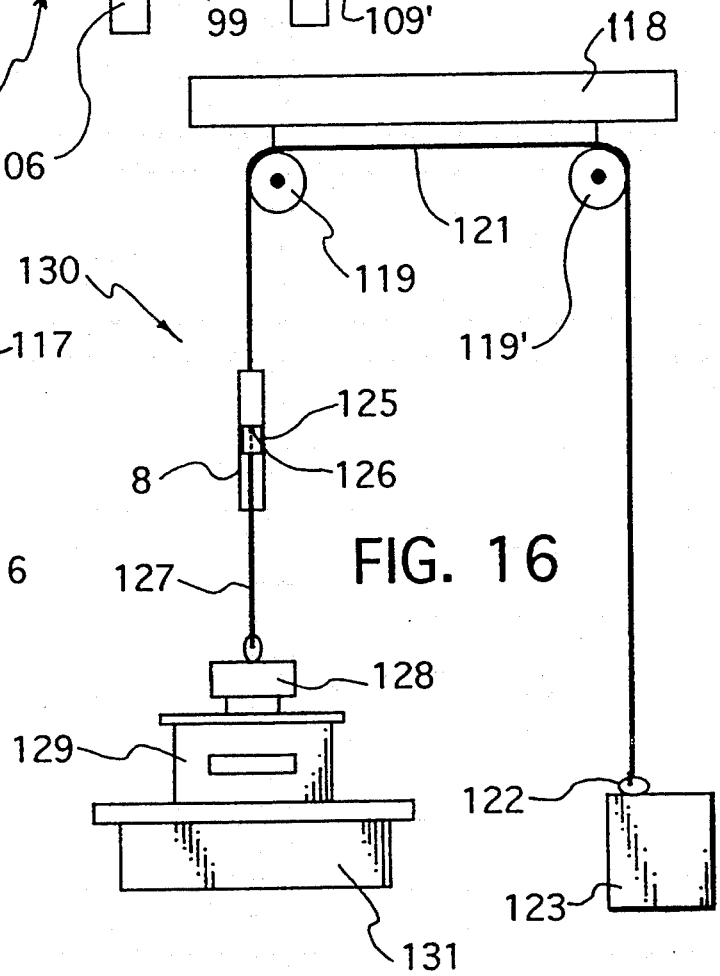
FIG. 16 shows one method for measuring the pressure differential (psi) required to slide and invert rubber discs according to this invention.
Figure 17:
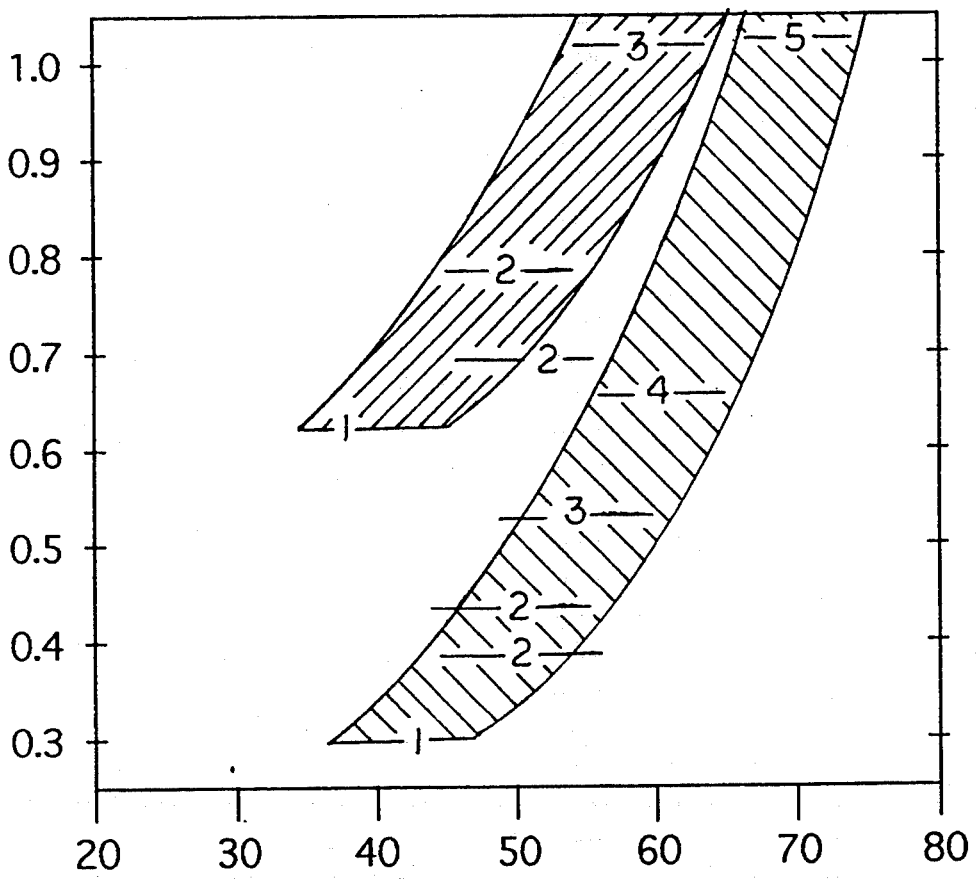
FIG. 17 is a plot of the Shore A hardness and pressure differential (psi) required to slide and invert rubber discs according to this invention. The vertical axis is the pressure in Psi required to slide and invert rubber disks and the horizontal axis is the Shore A hardness of the piston rubber.

A testing apparatus was designed to test the devices of this invention and with reference to FIG. 16, there is shown a testing device 130 which has a support beam 118 for the pulleys 119 and 119' over which there runs a small diameter (1/16 inch diameter) cable 121. The cable 121 is securely anchored on its non-working end 122, to a support 123. The cable 121 is attached on its opposite end 124 to a quick release connector 105 which is attached to the tube 8. In this set of experiments, the tube 8 is pulled upwards over the piston 125 which is located in the tube 8. The piston 125 is shown attached to a fine wire 126 (in phantom) within the center of the bottom cup of the piston 125. There is also shown a drop thread 127 connected to the fine wire 126. The drop thread 127 is further attached to a 1 kilogram tared weight 128 on a balance 129, which is supported by a support 131. The balance in this example was a Mettler PC 2000 electronic scale which measures weight added or subtracted.

In use, the cable 121 is disconnected from the tube 8 to permit insertion of the piston 125, with a drop thread 127 connected to it. The drop thread 127 is in turn connected to the weight 128 while it is setting on the balance 129. The cable 121 is then reconnected to the tube 8 and pulled downward at about 1 inch per second to move the tube upward with the piston 125 held stationary. A decrease of tared weight on the balance 128 is recorded as the piston 125 slides linearly inside the tube 8. The weight required to move the piston is divided by the tube cross-sectional area to provide force data for the report herein.

The testing of the devices was carried out on a piston wherein the diameter of the small end of a cup is 4 cm (1.5748 inches) and the large end is 4.4 cm (1.7323 inches). The tube used in this experiment was a transparent polycarbonate tube having an O.D. of 2 inches and I.D. of 1.75 inches. When a piston is inserted into the tube, the clearance between the tube wall and the large ends of the piston is about 0.225 mm. A piston with no disk in the center slides freely with negligible resistance in the tube. When a piston with a 2 inch diameter disk having a thickness of 1/32 inches is used, the disk rubs against the internal surface of the tube, but there is still a clearance of 1.43 mm between the small diameter center of the cup and the disk. It is obvious that if the cup had the larger diameter for its full length, that, 1.7323 inches, there would be no clearance between the 1/32 inch disk and the tube wall such that the disk could bend. The protruding edges of the disk would wedge between the cup and the tube wall and the piston could move.

The step designed cup thus permits the necessary clearance between the flexible disk and the tube wall to permit the piston to slide when air pressure is exerted from either end of the exerciser, while still maintaining excellent alignment. Optionally, a tapered cup design could accomplish the same purpose, that of getting the cup out of the way of the bending flexible disk. If the cups were smaller, then the piston could not maintain its alignment in the tube and it would bind. Thus, it can be understood by those skilled in the art that thicker disks, up to a maximum thickness that would not tolerate easy bending and non-reversibility of the disk, can be used in this invention if spacers with smaller diameters than the small cup end is used as is illustrated in FIGS. 2 and 4, item 15.

To give an idea of the criticality of certain of the parameters set forth above for this invention, several disks were tested to determine their usefulness.

By way of example, several materials were obtained by the inventors, and disks 6 were cut from each to determine their use in this invention. The materials are described in the Table I below.

TABLE I

| TYPE OF MATERIAL | THICKNESS inches | mm |
|---|---|---|
| red silicone rubber | 1/32 | 0.0794 |
| EPDM* | 1/32 | |
| EPDM | 1/16 | 1.588 |
| translucent silicone | 1/16 | |
| white vinyl/nitrile | 1/32 | |
| white vinyl/nitrile | 1/16 | |
| white vinyl/nitrile | 3/32 | 2.3813 |
| white vinyl/nitrile | ⅛ | 3.175 |
| FDA-BUNA N** high strength | 1/16 | |
| natural latex | 1/16 | |
| natural rubber sponge | ⅛ | |

*ethylene-co-propylene rubber;
**butadiene-co-acrylonitrile rubber

EXAMPLE 1

Three disks of 0.187, 0.194, and 2.00 inch diameter were cut with a dual blade gasket cutter from the red silicone of Table I. When the disks were tested in the apparatus of FIG. 14, the results were as shown in Table II.

TABLE II

| Sample # | Thickness (inches) | Disk Dia. (inches) | A | B |
|---|---|---|---|---|
| 1 | 0.0313 | 1.875 | 0.130 | 0.241 |
| 2 | 0.0313 | 1.937 | 0.154 | 0.312 |
| 3 | 0.0313 | 2.000 | 0.237 | — |

A = Force to move the piston (#/Sq. In.)
B = Force to invert the disc (#/Sq. In.)

Samples 1 and 2 show that reversal of the disc edge bending direction occurs during the first 1 to 3 inches of piston movement when the direction of force acting on the piston is reversed. Disk inversion is inconsistent and more difficult with a larger diameter disk as shown in sample 3. When the pistons of samples 1 and 2 were forced into the 1.75 inch I.D. tube, the rubber disk bent smoothly and the edge contacted the tube wall uniformly. The edges did not wrinkle and a good seal was formed between the tube wall and the piston, without seizure of the piston in the tube. The sample 3 piston wrinkled noticeably when the piston was inserted into the tube. The wrinkles formed in the edge of the disk of sample 3 do not reduce the force required to pull the piston inside the tube, but they allow air to pass between the tube and the piston causing gas to be lost. This experiment shows that a 0.0313 thick silicone rubber disk with diameter less than or equal to 11% greater than the I.D. of the tube does not wrinkle and forms an excellent gas seal. A disk of 14% greater diameter than the 1.75 inch tube I.D. wrinkles badly and produces a poor seal. The "wrinkle formation criterion" is useful to specify the maximum diameter of the disks. The minimum disk size will be the diameter required to produce a minimum resistance to "free reciprocation:" of the piston when no lubricant is present. This "minimum resistance" value should be specified to be a differential force equal to or greater than 0.05 psi.

EXAMPLE 2

As noted above, this invention also contemplates multiple-disk pistons with a spacer between the disks as is shown in FIGS. 2 and 4. Table III below tabulates data from experiments performed using ten 1.927 inch diameter disks that were cut from the same silicone rubber as was used in the Table II results. Six 1.5 inch diameter spacer disks with 3/16 inch center holes were cut from 0.25 inch thick 4 pound/cubic foot semi-rigid structural foam sheet. The material was linear polyethylene having closed cells of 1 mm average cell size obtained from solid 0.965 gm/ml linear polyethylene having a 15 to 1 expansion. Pistons were assembled by matching the 3/16 inch hole in the center of a disk with a 3/16 inch hole through the solid end of one of the plastic cups. A foam spacer disk was placed over the rubber disk and the procedure repeated to produce a piston with the desired number of rubber and foam disks between the cup bottoms. The entire assembly was tightly riveted together via a rivet fastener. Each assembly was tested in the apparatus of FIG. 14 with the results set forth in Table III.

TABLE III

| Sample # | Thickness (inches) | Diameter (inches) | # Disks | A | B |
|---|---|---|---|---|---|
| 4* | 1/32 | 1.937 | 1 | 0.154 | 0.312 |
| 5 | " | " | 2 | 0.293 | 0.572 |
| 6 | " | " | 3 | 0.446 | 0.780 |
| 7 | " | " | 4 | 0.623 | 0.981 |

*sample 2 piston from Table II
A = Force to move piston (#/Sq. In.)
B = Force to invert Disks (#/Sq. In.)

Each piston performed well when inserted into a 1.75 inch I.D. polycarbonate tube. Forces required to pull pistons through the tube increase in direct proportion to the number of disks. Forces required to invert the direction of disk bending also increase with the number of disks and average about 1.8 times the normal sliding force.

EXAMPLE 3

A piston was made from four 1.94 inch diameter 8 mil thick dental dam material disks held in intimate contact with one another between cups. The piston weighted 20.1 grams and when it was slipped into a vertical 1.75" I.D. polycarbonate tube, it fell jerkily under it's own weight when the tube was jiggled. With the tube held in a horizontal position, the piston slid with a differential gas pressure of 0.02 to 0.025 psi, meaning that this piston was "freely reciprocating" according to the definition give supra. This piston thus slides when the differential pressure was less than 0.05 psi.

EXAMPLE 4

Pistons were prepared using the translucent silicone rubber shown in Table I. This material had a tensile strength of 1200 psi and a durometer shore A of 45 to 55. The indentation hardness is in the mid-range on the Shore A scale. It is stiffer than a rubber band but softer than auto tire thread rubber. The results can be found in Table IV.

TABLE IV

| Sample # | Clearance of Disk (inches) | Thickness (inches) | Diameter (inches) | A | B |
|---|---|---|---|---|---|
| 8 | 0.025 | 0.0625 | 1.937 | 0.615 | >1.3 |
| 9 | 0.065 | " | " | 0.480 | 0.87 |
| 10 | 0.0625 | " | " | 0.460 | 0.84 |

A = Force to move piston (#/Sq. In.)
B = Force to invert the disk (#/Sq. In.)

With a 25 mil clearance the disk edge did not wedge or bind against the tube wall when the piston slides in one direction but it was difficult to reverse the bending direction as the disk edge folds back over itself to effectively double the rubber thickness and resist piston sliding in the opposite direction.

The piston from sample 8 had only the disk between the cups with no foam spacer disk. The piston from sample 9 had 0.25 inch thick by 1.5 inch diameter foam discs on both side of the rubber disk to increase the clearance between disk edges and the tube wall from 25 mils to 62 mils. This greater clearance facilitates inversion when the piston sliding direction is reversed. The piston from sample 10 is similar but one disk spacer is only 0.125 inches thick. The pistons from 0.062 inch silicone rubber of this example bend over when the piston is inserted into a tube of specified I.D. to form excellent slidable gas seals with the tube wall. A piston with one 0.062 inch thick disk requires about the same sliding force as a piston made with four 0.03125 inch thick disks. Inversion force requirements are another important design parameter. A patient with an obstructive lung disease and poorly conditioned breathing muscles may not be capable of reversing the piston direction by forced expiration into the opposite end of the tube when the piston stops. It may also be desirable to exercise breathing muscles by working against a specified resistance to linear motion. In the device of the instant invention, application of mechanical force via other methods can resolve the problem of excess piston disk inversion pressure requirements. A patient with inadequate breathing pressure can insert a rigid probe into the open mouthpiece tube end and push on the piston until inversion occurs.

EXAMPLE 5

Effect of Using Pistons Made with Thicker Rubber Disks

From beam analyses, pressure differentials required to slide a piston in a tube would increase proportionally to the cube of the disk thickness. Different thickness rubber disks were tested in the following manner. The results are on table V.

TABLE V

| Sample # | Rubber Type | Hardness Shore A | Thk. (mils) | Dia. (in.) | Dimen. No. of Disks | Dimen. No. of Spacers | A | B |
|---|---|---|---|---|---|---|---|---|
| 11 | nat.* | 35–45 | 64 | 1.937 | 1 | 0 | 0.48 | >1.4 |
| 12 | nat. | " | 64 | " | " | 4 | 0.29 | 0.63 |
| 13 | sil. | 45–55 | 62 | 1.937 | " | 0 | 0.58 | >1.20 |
| 14 | " | " | 62 | " | " | 4 | 0.37 | 0.70 |
| 15 | " | " | 62 | 2.000 | " | 4 | 0.43 | 0.78 |
| 16 | EPDM | 55–65 | 64 | 1.937 | " | 4 | 0.53 | 1.00 |
| 17 | BUNA N | 55–65 | 65 | " | " | 4 | 0.65 | >1.3 |
| 18 | Vi/Nit | 65–75 | 64 | " | " | 4 | 1.02 | >1.3 |

TABLE V-continued

| Sample # | Rubber Type | Hardness Shore A | Thk. (mils) | Dia. (in.) | Dimen. No. of Disks | Dimen. No. of Spacers | A | B |
|---|---|---|---|---|---|---|---|---|
| 19 | " | " | 84 | " | " | 4 | >1.3 | >1.3 |

A = Force to move the piston in psi
B = Force to invert in psi
*11 and 12 = natural rubber; 13, 14, and 15 = silicone rubber; 16 = ethylene-co-propylene rubber; 17 = butadiene-co-acrylonitrile copolymer rubber, and 18 and 19 = polyblend of polyvinyl chloride with butadiene-co-acrylonitrile.

The pistons made with samples 11 and 12 did not slide as smoothly in the tube as when silicone rubber is used. Sample 15 disk wrinkled when inserted into a 1.75 inch tube. The 64 mil thick vinyl/nitrile rubber is too stiff for use in a 1.75 inch I.D. tube.

The plot as shown on FIG. 15 illustrates the most useful materials for the disks of the instant invention. FIG. 15 has as it's vertical axis the pressure differential (psi) required to slide and invert rubber discs when used in a piston of this invention. The horizontal axis has the Shore A hardness of piston rubber disks.

The ▨ represents the point of disk edge inversion and the ▧ represents the point of smooth sliding for each of the materials.

In each case, 1=natural rubber; 2=silicone; 3=EPDM; 4=BUNA, and 5=vinyl/nitrile.

As can be observed, there is an approximate correlation between piston sliding force requirements and Shore hardness of the 1/16 inch thick rubber disks.

EXAMPLE 6

Low density, soft, flexible cellular sponge rubber was tested as a flexible disk in a piston of this invention. The disk was 1.94 inches in diameter and was ⅛ inch thick. The disc was positioned between two 0.5 inch thick by 1.5 inch diameter rigid foam spacer disks and fastened between the closed ends of 2 caps to form a piston. The force required to slide this piston in a 1.75 inch diameter polycarbonate tube is very low in comparison with solid rubbers. A differential pressure of only 0.089 psi causes the piston to slide. The pressure required to invert the disk is 0.175 psi. These very low force requirements to slide the piston and invert the disks could be useful for breathing exercises by patients with severely impaired respiratory functions. The foam disk seals well and the piston slides smoothly.

Finally, with regard to the strength required to invert a disk in certain of the devices of this invention, the inventors have recognized that it takes a stronger force to invert the disk than it does to move it in the tube once the inversion of the disk has taken place and the piston has started to move through the tube. In those situations where the particular exerciser has a piston designed such that the patient cannot exceed the inversion force the inventors herein have found that an annular ring 114 (see FIG. 12) cut into the inside surface of the tube, at the point on each end of the tube where the disk comes to rest, will allow the disk to assume an upright position such that there is no inversion force required to move the piston. In use, the piston comes up against the terminal end of the tube and it is at this point that the annular ring 114 is cut into the inside surface of the tube to facilitate this embodiment of the invention. Reference should be made to FIG. 12, item 114 and 114', which are the annular rings Also contemplated within the scope of this invention is the use of filters in the exerciser. These filters should have good capacity to effectively remove and hold most of the water vapor from breath exhaled into the tube; it should be easy to remove, dispose of, and replace with a new filter after use; it should allow for the controlled rate of air passage through the filter during normal use and it must be available at a reasonable cost so that the user will replace the contaminated filter frequently. The terminal fixture 9 of the exerciser 10 such as that shown in FIG. 7 offers a convenient design for the insertion of tubular filters. During normal use, expired air will never be inhaled through the in-line filters shown in FIG. 16. In FIG. 16, there is shown a filter 107 of this invention which is shaped like a cigarette with a collar. The filter 107 is a roll of a porous, water absorbent material 105, which has been rolled to form a multilayer filter. The collar 106 is used to stabilize the filter 107 in the terminal fixture 9 of a device of this invention. It is contemplated within the scope of this invention to fashion the filter tube holder out of brass, with a brass washer which can be surmounted by a rubber O-ring to act as a washer in the system.

Thus, what has been described is a device which is an exerciser for the lungs.

We claim:

1. A respiratory exerciser, said respiratory exerciser comprising in combination:

A. a piston for use in a cylindrical tube including two cups and at least one flexible disk and a fastening means, each said cup being configured essentially identical to the other, each said cup comprising a back and an outside diameter; each said cup joined to the other cup in back to back interfacial relationship to form a piston; said cups having at least one flexible disk centered between their joined backs; each flexible disk having a diameter larger than the largest outside diameter of the cups, said fastening means securing the cups and the flexible disk together;

B. an elongated cylindrical tube having an inside diameter greater than the largest outside diameter of the piston, but smaller than the largest diameter of the largest flexible disk of the piston;

C. a mouthpiece attached to at least one end of the elongated cylindrical tube to allow passage of air into the elongated cylindrical tube.

2. A respiratory exerciser as claimed in claim 1 which also includes a filter.

3. A respiratory exerciser as claimed in claim 2 wherein the filter is disposable.

4. A respiratory exerciser as claimed in claim 1 wherein each mouthpiece C., is detachable.

* * * * *